US009687091B2

(12) United States Patent
Jhagroo

(10) Patent No.: US 9,687,091 B2
(45) Date of Patent: Jun. 27, 2017

(54) DISPLAY FRAME SYSTEM, KIT, AND METHOD

(71) Applicant: Andre Jhagroo, Fort Lauderdale, FL (US)

(72) Inventor: Andre Jhagroo, Fort Lauderdale, FL (US)

( * ) Notice: Subject to any disclaimer, the term of this patent is extended or adjusted under 35 U.S.C. 154(b) by 0 days.

(21) Appl. No.: 15/137,376

(22) Filed: Apr. 25, 2016

(65) Prior Publication Data

US 2016/0309926 A1 Oct. 27, 2016

Related U.S. Application Data

(60) Provisional application No. 62/152,598, filed on Apr. 24, 2015.

(51) Int. Cl.
*A47G 1/06* (2006.01)

(52) U.S. Cl.
CPC ..... *A47G 1/065* (2013.01); *A47G 1/0616* (2013.01)

(58) Field of Classification Search
CPC ..... A47G 1/065; A47G 1/0605
See application file for complete search history.

(56) References Cited

U.S. PATENT DOCUMENTS 3,529,374 A * 9/1970 Spertus ..... A47G 1/065 40/730
3,648,393 A * 3/1972 Parrilla ..... A47G 1/065 40/657
3,673,724 A * 7/1972 Bell ..... A47G 1/12 40/729
3,722,122 A * 3/1973 Sesto ..... A47G 1/065 40/730
4,017,989 A * 4/1977 Murray ..... G09F 1/12 40/605
4,608,770 A 9/1986 Gray
4,712,322 A * 12/1987 Rubin ..... A47G 1/1646 40/730
5,220,952 A * 6/1993 Beaulieu ..... G09F 15/0068 160/135
5,477,628 A * 12/1995 Chen ..... A47G 1/0616 40/784
5,581,922 A * 12/1996 Heimann ..... G09B 1/36 40/605
5,588,240 A 12/1996 Zilliox
6,338,215 B1 1/2002 Vincent
(Continued)

*Primary Examiner* — Gary C Hoge
(74) *Attorney, Agent, or Firm* — The Concept Law Group, P.A.; Scott D. Smiley; Yongae Jun

(57) ABSTRACT

A display system includes at least one picture frame with a front face having an inner perimeter edge sized and shaped to frame a display item therein; and a sidewall. The sidewall, together with the front face, at least partially forms a hidden recessed channel disposed behind the front face of the picture frame so as to be concealed behind the front face when viewed by the viewer from the front side of the picture frame and simultaneously unconcealed from a lateral side of the picture frame when viewed by the viewer from the lateral side of the picture frame in a wall-mounted configuration. The sidewall defines a plurality of bore-holes sized to receive a partial length of a coupling member therein and oriented to receive the partial length of the coupling member therein from the lateral side of the picture frame.

20 Claims, 13 Drawing Sheets

(56) References Cited

U.S. PATENT DOCUMENTS

| | | | | |
|---|---|---|---|---|
| 6,347,472 | B1 * | 2/2002 | Dominguez | A47G 1/02 40/605 |
| 8,333,026 | B2 | 12/2012 | Southard | |
| 8,480,247 | B2 | 7/2013 | Fleet et al. | |
| 2007/0234621 | A1 * | 10/2007 | McCorkle | A47G 1/065 40/773 |
| 2010/0229439 | A1 | 9/2010 | Elliot | |
| 2013/0344467 | A1 | 12/2013 | Norcross | |
| 2014/0047747 | A1 | 2/2014 | Jackson | |

* cited by examiner

100

1200

DISPLAY FRAME SYSTEM, KIT, AND METHOD

CROSS-REFERENCE TO RELATED APPLICATION

This application claims priority to U.S. Provisional Patent Application No. 61/152,598 filed Apr. 24, 2015, the entirety of which is incorporated by reference.

FIELD OF THE INVENTION

The present invention relates generally to a display system, kit, and method, and, more particularly, relates to picture frames.

BACKGROUND OF THE INVENTION

It is well known that consumers desire unique, personalized decorative items for display. Purchasing such items can be very expensive. Recently, there has been an increase in popularity in do-it-yourself (DIY) crafts. Unfortunately, creating unique, personalized decorative items for display can be time-consuming, complicated, and expensive. Therefore, what is needed is an assembly, kit, and method for consumers to create unique, personalized decorative items for display that is low-cost, efficient, and easy to use.

Therefore, a need exists to overcome the problems with the prior art as discussed above.

SUMMARY OF THE INVENTION

The invention provides a display system, kit, and method that overcomes the hereinafore-mentioned disadvantages of the heretofore-known devices and methods of this general type and that allows for quick and easy formation of self-customizable frame collages.

With the foregoing and other objects in view, there is provided, in accordance with the invention, a display system including a picture frame having: a front face with an inner perimeter edge sized and shaped to frame a display item therein so as to be viewable from a front side of the picture frame by a viewer; and a sidewall: together with the front face, at least partially forming a hidden recessed channel disposed behind the front face of the picture frame so as to be concealed behind the front face when viewed by the viewer from the front side of the picture frame and simultaneously unconcealed from a lateral side of the picture frame when viewed by the viewer from the lateral side of the picture frame in a wall-mounted configuration; and defining a plurality of bore-holes sized to receive a partial length of a coupling member therein and oriented to receive the partial length of the coupling member therein from the lateral side of the picture frame.

In accordance with another feature of the present invention, the coupling member is formed as a dowel fastener and each of the plurality of bore-holes is sized to receive the partial length of the dowel fastener therein.

In accordance with a further feature of the present invention, the picture frame is rectangle-shaped.

In accordance with a further feature of the present invention, the picture frame further comprises a rear face, the front face and the rear face disposed on opposing sides of the hidden recessed channel.

In accordance with another feature of the present invention, the hidden recessed channel extends continuously about the inner perimeter edge.

In accordance with another feature of the present invention, the picture frame is formed as an injection-molded member.

In accordance with another feature of the present invention, the picture frame is of a wood material.

In accordance with another feature of the present invention, the plurality of bore-holes are equally spaced apart from one another.

In accordance with another feature of the present invention, each of the plurality of bore-holes defines a central axis extending in a direction parallel to a plane defined by the front face of the picture frame.

In accordance with yet another feature, an embodiment of the present invention further includes a second picture frame having: a front face with an inner perimeter edge sized and shaped to frame a display item therein so as to be viewable from a front side of the second picture frame by the viewer; and a sidewall: together with the front face, at least partially forming a hidden recessed channel disposed behind the front face of the second picture frame so as to be concealed behind the front face of the second picture frame when viewed by the viewer from the front side of the second picture frame and simultaneously unconcealed from a lateral side of the second picture frame when viewed by the viewer from the lateral side of the second picture frame in the wall-mounted configuration; and defining a plurality of bore-holes sized to receive a partial length of a coupling member therein and oriented to receive the partial length of the coupling member therein from the lateral side of the picture frame; and at least one coupling member having a body sized and shaped for a partial insertion within one of the plurality of bore-holes of the picture frame and a simultaneous partial insertion within one of the plurality of bore-holes of the second picture frame for coupling the picture frame to the second picture frame.

In accordance with yet another feature, an embodiment of the present invention includes a display kit including: at least one picture frame having: a front face with an inner perimeter edge sized and shaped to frame a display item therein so as to be viewable from a front side of the at least one picture frame by a viewer; and a sidewall: together with the front face, at least partially forming a hidden recessed channel disposed behind the front face of the at least one picture frame so as to be concealed behind the front face when viewed by the viewer from the front side of the at least one picture frame and simultaneously unconcealed from a lateral side of the at least one picture frame when viewed by the viewer from the lateral side of the at least one picture frame in a wall-mounted configuration; and defining a plurality of bore-holes sized to receive a partial length of a coupling member therein and oriented to receive the partial length of the coupling member therein from the lateral side of the at least one picture frame; and a plurality of coupling members shaped for insertion within the plurality of bore-holes for the at least one picture frame.

In accordance with another feature, an embodiment of the present invention includes a method for creating a collage of picture frames, the method includes: providing a first picture frame having at least one sidewall defining a plurality of spaced apart through-holes; providing a second picture frame having at least one sidewall defining a plurality of spaced apart through-holes; inserting a first end of at least one coupling member through a first one of the plurality of spaced-apart through-holes defined by the first picture frame; co-axially aligning the first one of the plurality of spaced-apart though-holes defined by the first picture frame with a second one of the plurality of spaced apart through-holes defined by the second picture frame; and selectively coupling the first and second picture frame together by inserting a second end of the at least one coupling member through the second one of the plurality of spaced apart though-holes, the second end opposite the first end.

Although the invention is illustrated and described herein as embodied in a display system, kit, and method, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of a bore hole from its entrance to its exit way.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
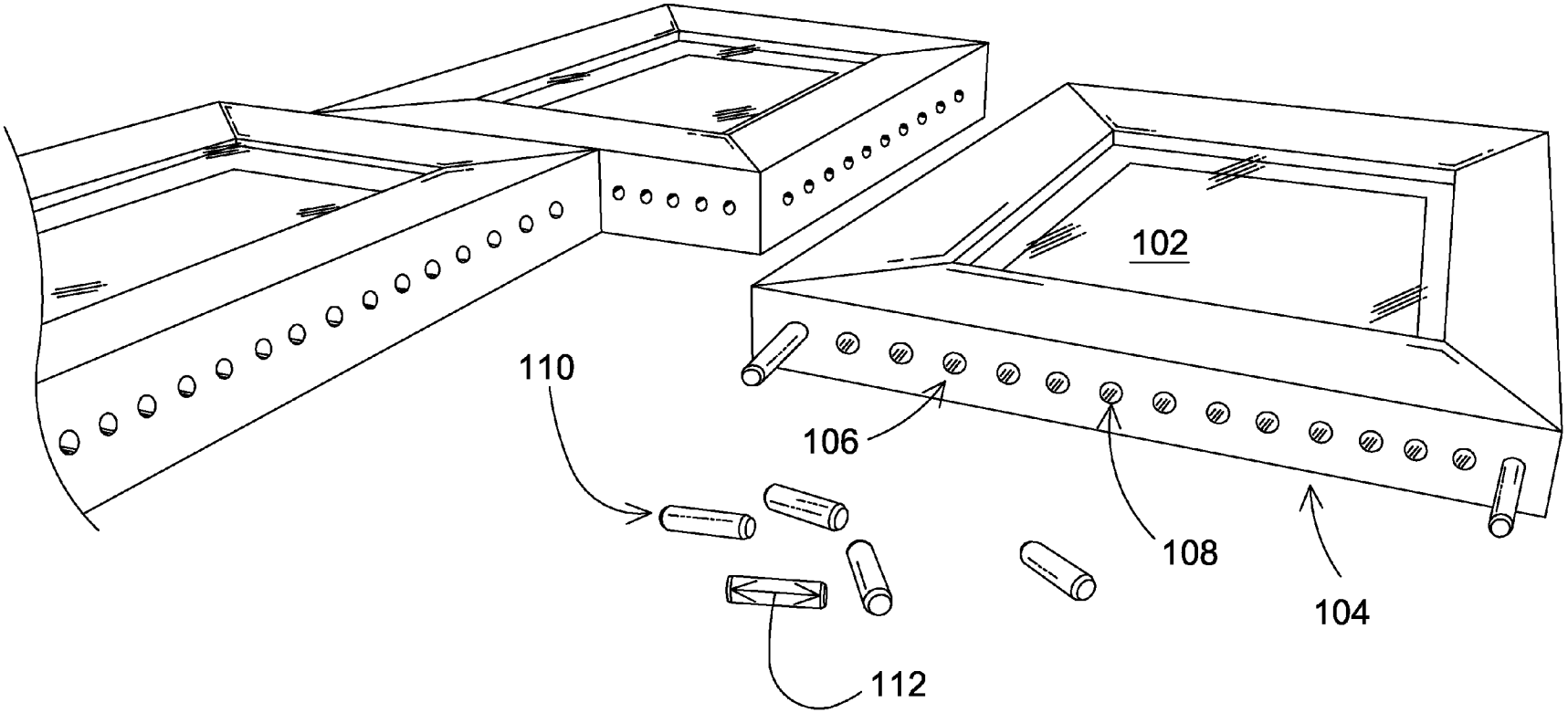
FIG. 1 is a side perspective view of a display system in accordance with an embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of a display system, as shown in FIG. 1, includes a plurality of picture frames 100 are illustrated. As used herein, the term "picture frame" is defined as a border or case for enclosing a photograph, mirror, painting, certificate, or other type of displayable item. Each of the plurality of frames 100 can include a front portion 102, a rear portion 104 opposite the front portion 102, and at least one sidewall 106. In one embodiment, the front portion 102 is a visually displayed portion of the picture frame 100. Stated another way, when the rear portion 104 of the picture frame 100 is attached to a wall for display, the front portion 102 is the portion of the picture frame 100 that is viewable by the viewer. In another embodiment, the front portion 102 may include a rectangular-shaped panel framing a transparent panel through which the displayed item (e.g., photograph) is viewable. In yet another embodiment, the front portion 102 may include a framing panel formed as other shapes (e.g., oval, circular, square, trapezoidal, triangular, or other polygon shape). In one embodiment, the rear portion 104 includes at least one wall coupling member operably configured to couple the picture frame 100 to a support surface, such as, a wall. In another embodiment, the wall coupling member can be formed as any known wall coupling member, such as, for example, a hook, a loop, a clip, a hanging strip, and the like.

In one embodiment, the sidewall 106 includes four sidewalls together forming a rectangular sidewall extending around the front portion 102. In another embodiment, each of the four sidewalls extends downwardly from a peripheral edge of the rectangular-shaped panel of the front portion 102 so as to be substantially perpendicular with the rectangular-shaped panel. In another embodiment, one or more of the four sidewalls defines a plurality of spaced apart through-holes 108. As used herein, the term "through-hole" is intended to indicate a hole or aperture that extends completely through an object from one surface of the object to an opposing surface of the object. In one embodiment, each of the plurality of through-holes 108 extends from an external surface of the sidewall 106 to an opposing interior surface of the sidewall 106. In another embodiment, each of the through-holes 108 are equally sized and shaped. In another embodiment, the through-holes 108 may be shaped and sized differently from one another. In yet another embodiment, each of the plurality of through-holes 108 on the sidewall are equally spaced apart, i.e. equidistant. In a further embodiment, each of the plurality of through-holes 108 is unequally spaced apart from one another. In yet a further embodiment, each of the plurality of through-holes 108 is circular shaped. In yet a further embodiment, each of the plurality of through-holes 108 is formed as other non-circular shapes. In one embodiment, all four sidewalls define a plurality of through-holes 108. In another embodiment, less than all four sidewalls define a plurality of through-holes 108. In yet another embodiment, the sidewall 106 is formed as other non-rectangular shapes (e.g., oval, circular, trapezoidal, triangular, or other polygon shape).

Figure 6:
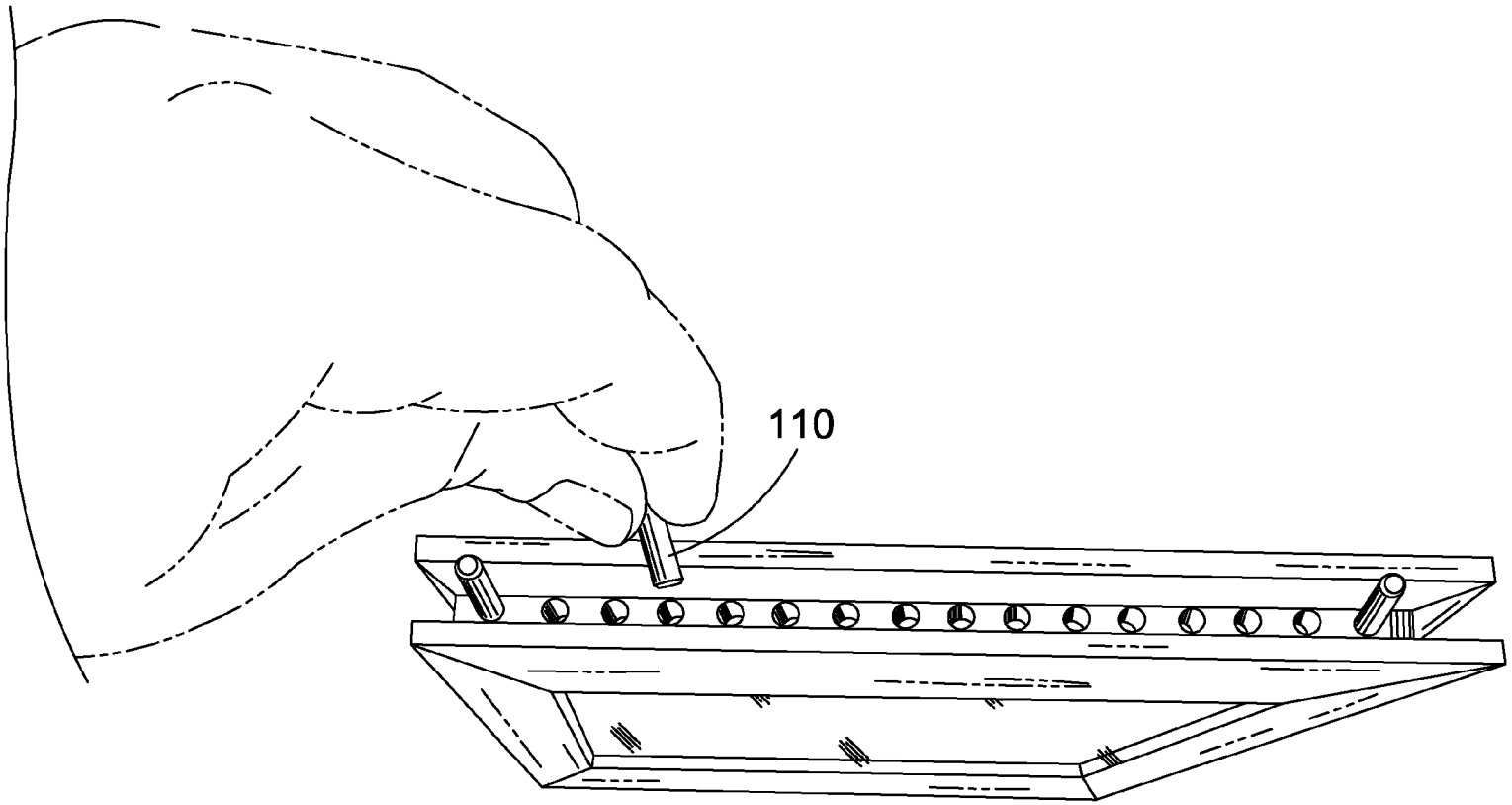
FIG. 6 is an upward-looking side perspective view of the picture frame of FIG. 3, in accordance with the present invention.

Referring still to FIG. 1, a plurality of coupling members 110 is illustrated. In one embodiment, each of the plurality of coupling members 110 is operably configured for insertion within the plurality of through-holes 108. More particularly, each of the plurality of coupling members 110 may be sized and shaped for frictional insertion within the through-holes 108 for securing one of the plurality of picture frames 100 to another one of the plurality of picture frames 100 (see FIGS. 6-7). In one embodiment, the shape and size of the through-holes 108 are substantially the same as the shape and size of a cross-section of the coupling members 110. For example, the through-holes 108 may be circular-shaped and the coupling members 110 may include a circular cross-section so as to be slideably insertable within the through-holes 108. In a further embodiment, a diameter of the coupling members 110 may be slightly smaller than a diameter of the through-holes 108 for a snug friction fit. In an embodiment where the through-holes 108 and coupling members 110 are non-circular (e.g. square shaped), a central width of the coupling members 110 may be slightly smaller than a central width of the through-holes 108 for a snug friction fit.

In one embodiment, each of the plurality of coupling members 110 is a peg or a pin. In another embodiment, the coupling members 110 are formed as dowel fasteners. In yet another embodiment, the coupling members 110 are formed as other types of known fasteners or attachments. In a further embodiment, each of the plurality of coupling members 110 includes a longitudinal length 112 sufficient to pass through a first through-hole 108 of one picture frame 100 as well as a second through-hole 108 of another adjacent picture frame 100, when said first and second through-holes 108 are adjacent to one another and co-axially aligned. Stated another way, the longitudinal length 112 of each of the plurality of coupling members 110 is at least twice a longitudinal length 112 of each of the plurality of through-holes 108.

Figure 8:
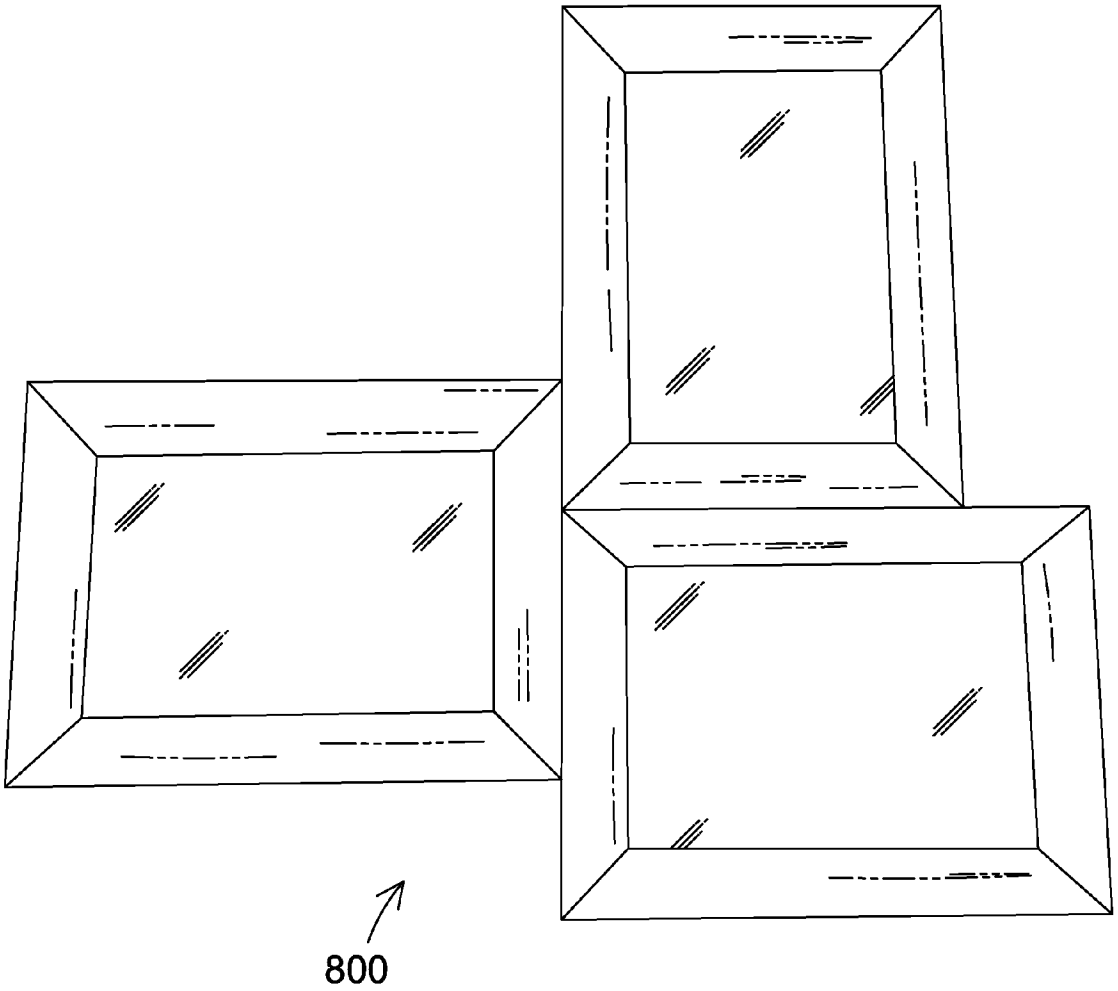
FIG. 8 is a front elevation view of an exemplary consumer-selected arrangement of the display system of FIG. 3 mounted to a wall, in accordance with an embodiment of the present invention.
Figure 9:
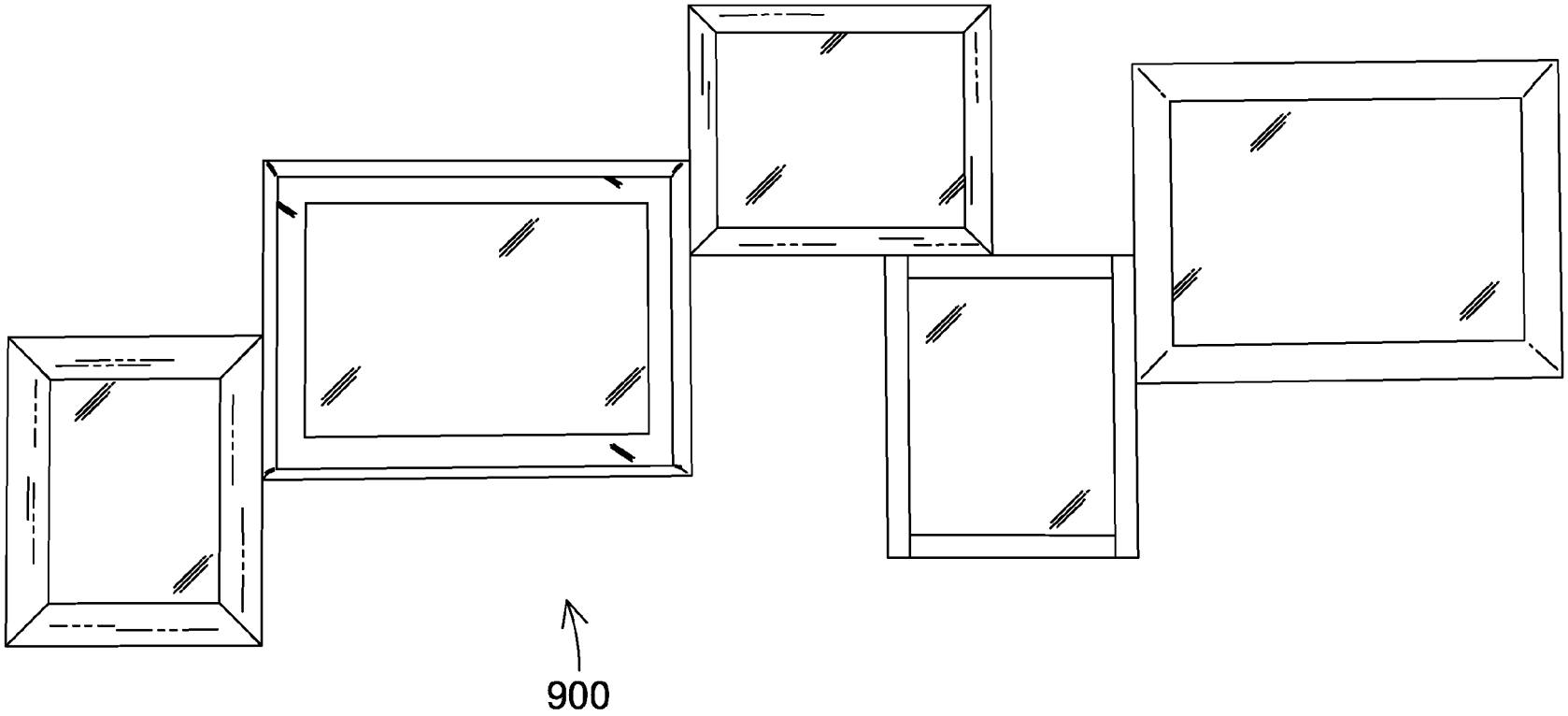
FIG. 9 is a front elevation view of yet another exemplary consumer-selected arrangement of a display system with five frames coupled together and mounted to a wall, in accordance with an embodiment of the present invention.

Referring FIG. 1, selective user assembly of the plurality of picture frames 100 and coupling members 110 is illustrated with reference to the flowchart depicted in FIG. 2. The flowchart in FIG. 2 describes an exemplary process for a consumer to selectively create a collage of picture frames for display. The process begins at step 200, where a first picture frame 100 is provided with at least one sidewall 106 defining a plurality of through-holes 108. In step 202, a second picture frame 100 is provided with at least one sidewall 106 defining a plurality of through-holes 108. In step 204, the consumer may insert a first end of the coupling member 110 through a first through-hole 108 defined by the first picture frame 100. In step 206, the consumer may align the first through-hole 108 with a second through-hole 108 defined by the second picture frame 100 (see, for example, FIG. 7). In one embodiment, the alignment can be considered a co-axial alignment of corresponding through-holes 108. In step 208, the consumer may selectively couple the first picture frame 100 to the second picture frame 100 using the coupling members 110. In one embodiment, the selective coupling is performed by inserting a second end of the coupling member 110 through the second through-hole 108 defined by the second picture frame 100. In another embodiment, the second end of the coupling member 110 is opposite to the first end of the coupling member 110. The consumer may continue to selectively couple picture frames 100 together in a similar manner to create a collage of picture frames 800 and 900, as illustrated in FIG. 8-9. Advantageously, consumers may couple any number of picture frames 100 together forming a multitude of unique, personalized picture frame configurations.

Figure 2:
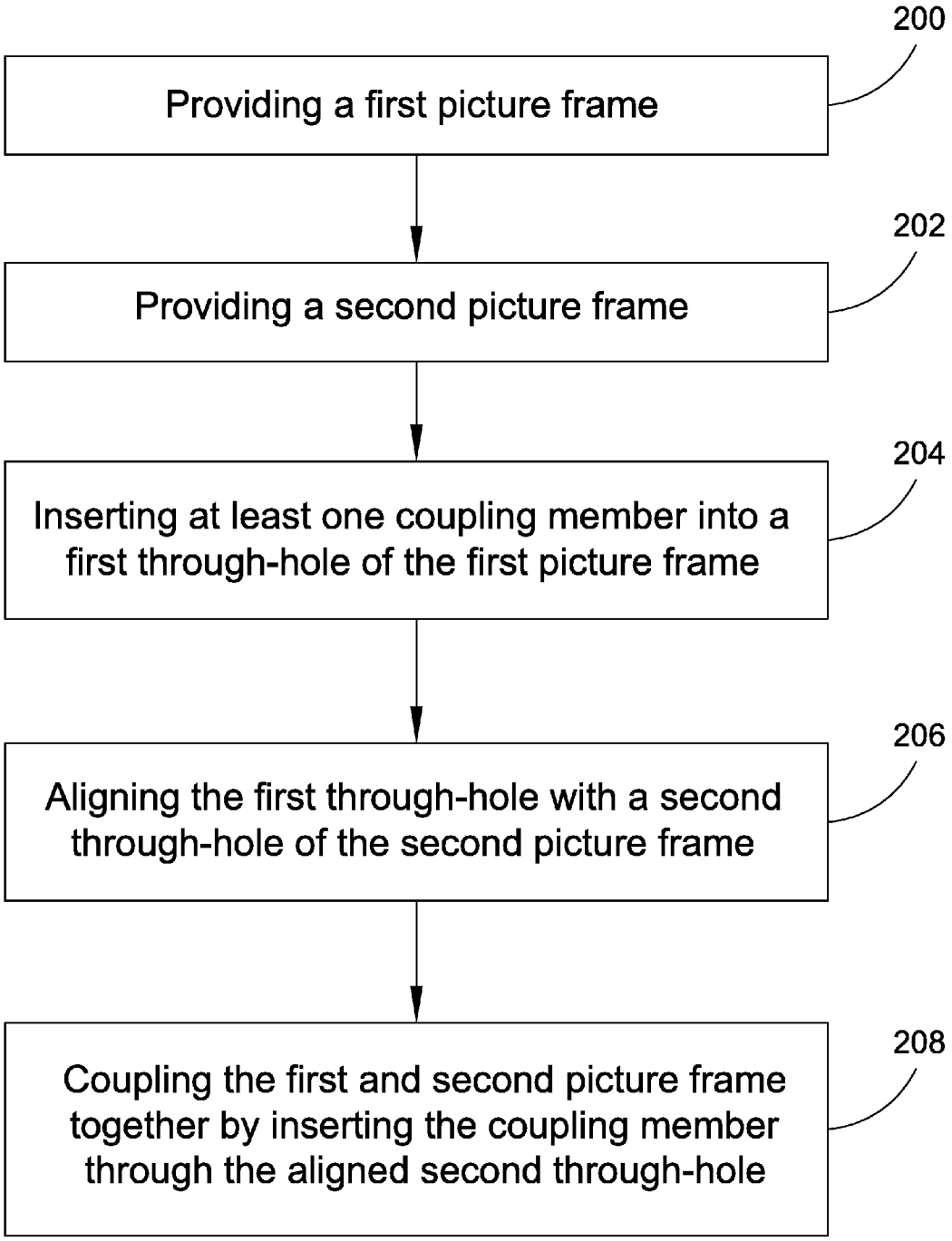
FIG. 2 is a process flow chart in accordance with an embodiment of the present invention.
Figure 3:
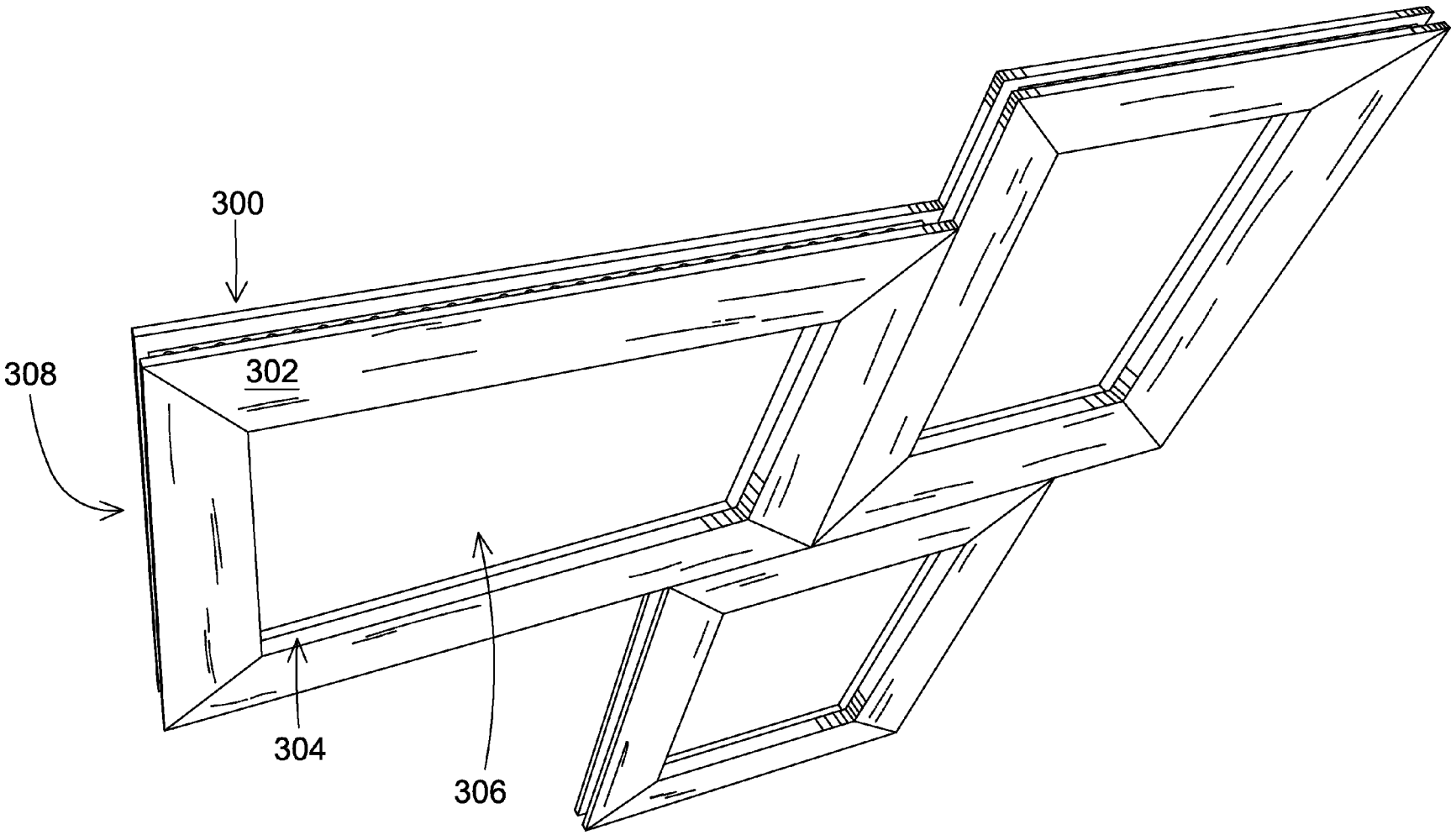
FIG. 3 is a front perspective view of another exemplary display system in accordance with the present invention.
Figure 4:
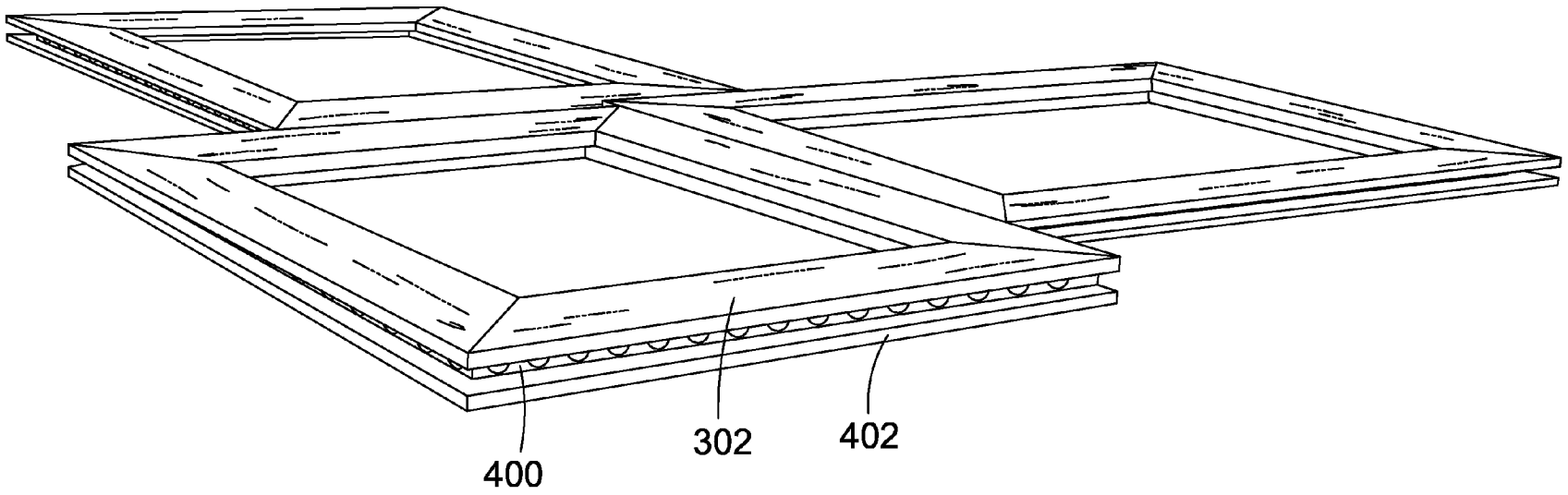
FIG. 4 is a side perspective view of the display system of FIG. 3, in accordance with the present invention.
Figure 5:
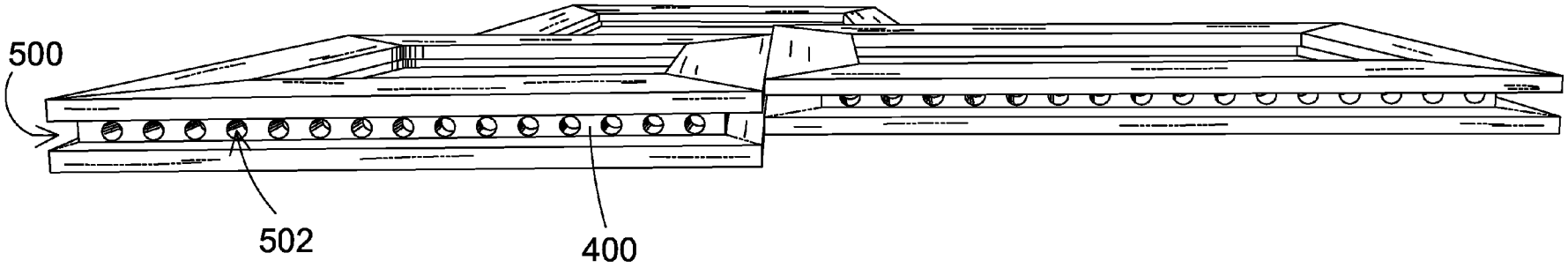
FIG. 5 is a side perspective view of the display system of FIG. 3, in accordance with the present invention.

Although FIG. 2 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted for the sake of brevity.

Referring now primarily to FIGS. 3-7, an alternative embodiment of the display system of the present invention is illustrated. The display system may include at least one picture frame 300. In one embodiment, the picture frame 300 includes a front face 302 with an inner perimeter edge 304 sized and shaped to frame a display item (not shown) therein so as to be viewable from a front side 306 of the picture frame by a viewer. In another embodiment, the picture frame 300 may include a sidewall 400. In one embodiment, the sidewall 400, together with the front face 302, at least partially forms a hidden recessed channel 500 disposed behind the front face 302 of the picture frame 300 so as to be concealed behind the front face 302 when viewed by the viewer from the front side 306 of the picture frame 300 and simultaneously unconcealed from a lateral side 308 of the picture frame 300 when viewed by the viewer from the lateral side of the picture frame 300 in a wall-mounted configuration. In other words, the sidewall 400 and bore-holes 502 are hidden from the viewers view by the front face 302, which extends beyond the perimeter of the sidewall 400, in order to provide a more aesthetically pleasing visual presentation.

In another embodiment, the sidewall 400 may define a plurality of bore-holes 502 sized to receive a partial length of a coupling member 110 therein and oriented to receive the partial length of the coupling member 110 therein from the lateral side 308 of the picture frame 300. The lateral side 308 can be considered to be the sides around the perimeter of the picture frame 300 that allow access into the hidden recessed channel 500 and ultimately the bore-holes 502 for insertion therein of the coupling members 110. The lateral side 308 does not include a front side, which is blocked from access into the bore-holes 502 by the front face 302.

In one embodiment, the coupling member 110 is formed as a dowel fastener and each of the plurality of bore-holes 502 is sized to receive the partial length of the dowel fastener therein. In one embodiment, the picture frame 300 is rectangle-shaped. More specifically, an outer perimeter edge and the inner perimeter edge 304 of the picture frame 300 are both rectangle shaped to form a rectangle frame.

In yet another embodiment, the picture frame 300 includes a rear face 402. In a further embodiment, the front face 302 and the rear face 402 are disposed on opposing sides of the hidden recessed channel 500. In one embodiment, the hidden recessed channel 500 extends continuously about the inner perimeter edge 304. In one embodiment, at least a portion of the picture frame 300 is formed from an injection-mold as an injection molded member. In another embodiment, the picture frame 300 is made of a wood material. In another embodiment, at least one bore-hole 502 is disposed on each face of the sidewall 400. For a rectangular-shaped frame, as in the exemplary embodiment, the sidewall 400 may be considered to include four faces corresponding to the four sides of a rectangle. The bore-holes 502 may be equally spaced apart from one another in an additional embodiment. In yet another embodiment, each of the bore-holes 502 may be considered to define a central axis extending in a direction parallel to a plane defined by the front face 302 of the picture frame 300.

Figure 7:
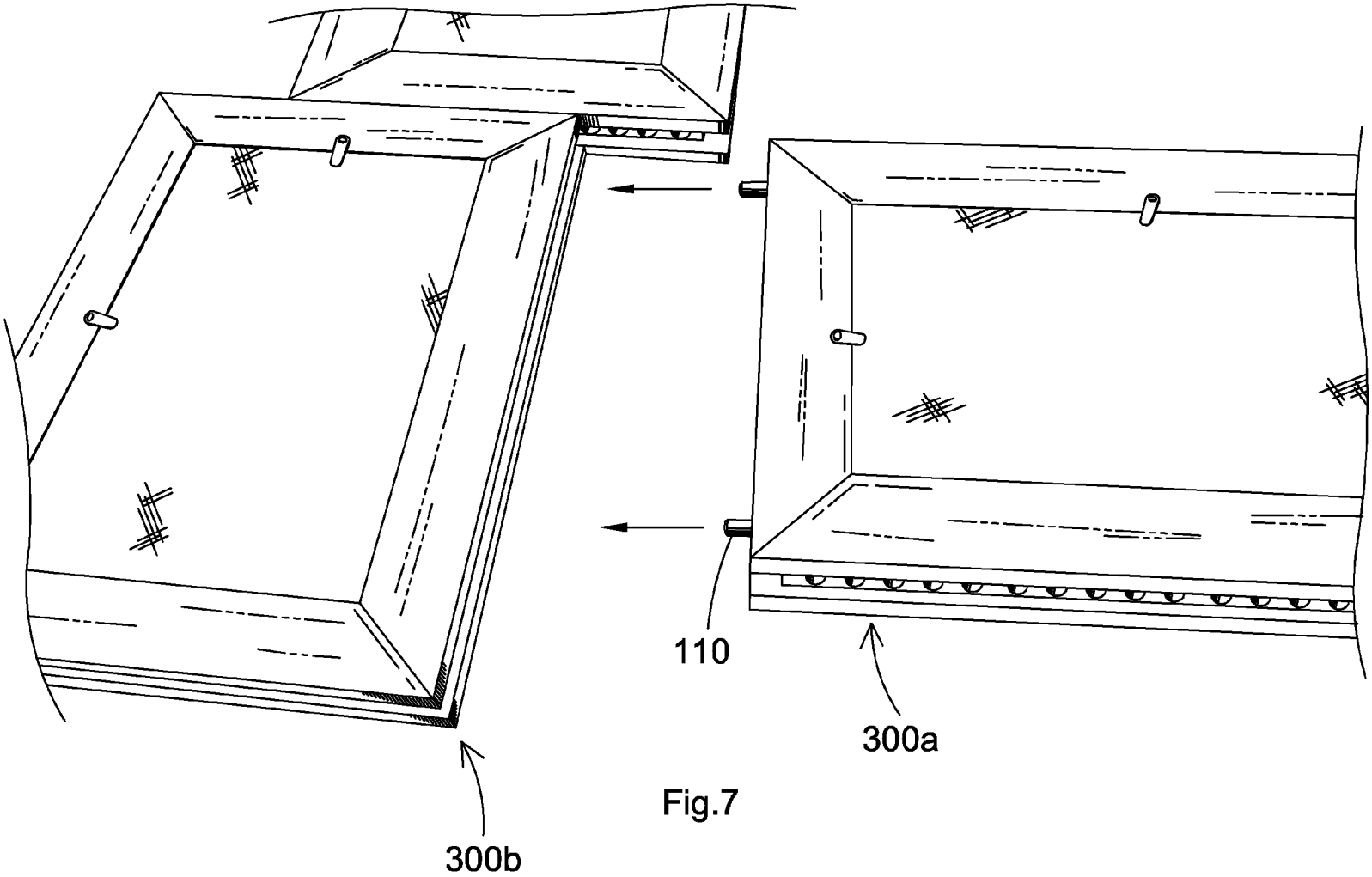
FIG. 7 is a top perspective view of the display system of FIG. 3, being coupled together with fasteners, in accordance with the present invention.

In one embodiment, the display system may be provided as a kit with at least a second picture frame 300*b* (identically or effectively similarly constructed as the first picture frame 300*a*) and a plurality of coupling members 110 for coupling the two frames together, as illustrated in FIG. 7.

Figure 10:
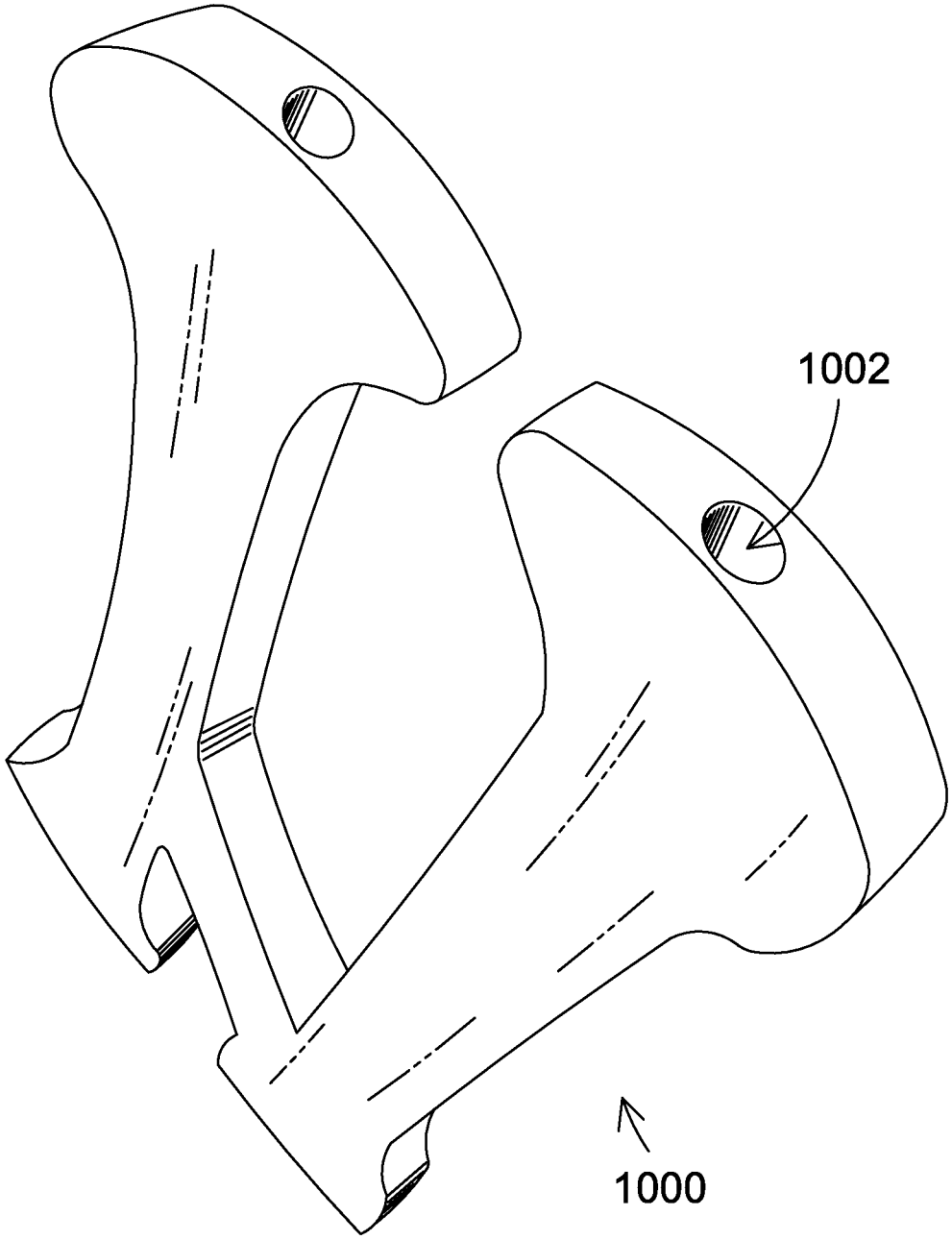
FIG. 10 is a downward-looking perspective view of a decorative feature, in accordance with an embodiment the present invention.

Referring now to FIG. 10, a decorative feature 1000 is illustrated in the shape of a letter with one or more apertures 1002 defined by a body of the decorative feature 1000. In other embodiments, the decorative feature 1000 may include other shapes and configurations, including, but not limited to, characters, symbols, musical notes, letters, numbers, words, names, toys, figurines, cartoon or movie characters, logos, jewels, and the like. In another embodiment, the apertures 1002 are sized and shaped to matingly receive the coupling members 110 for selective coupling to a picture frame 100, as described above with respect to coupling picture frames 100 to one another (FIG. 1).

Figure 11:
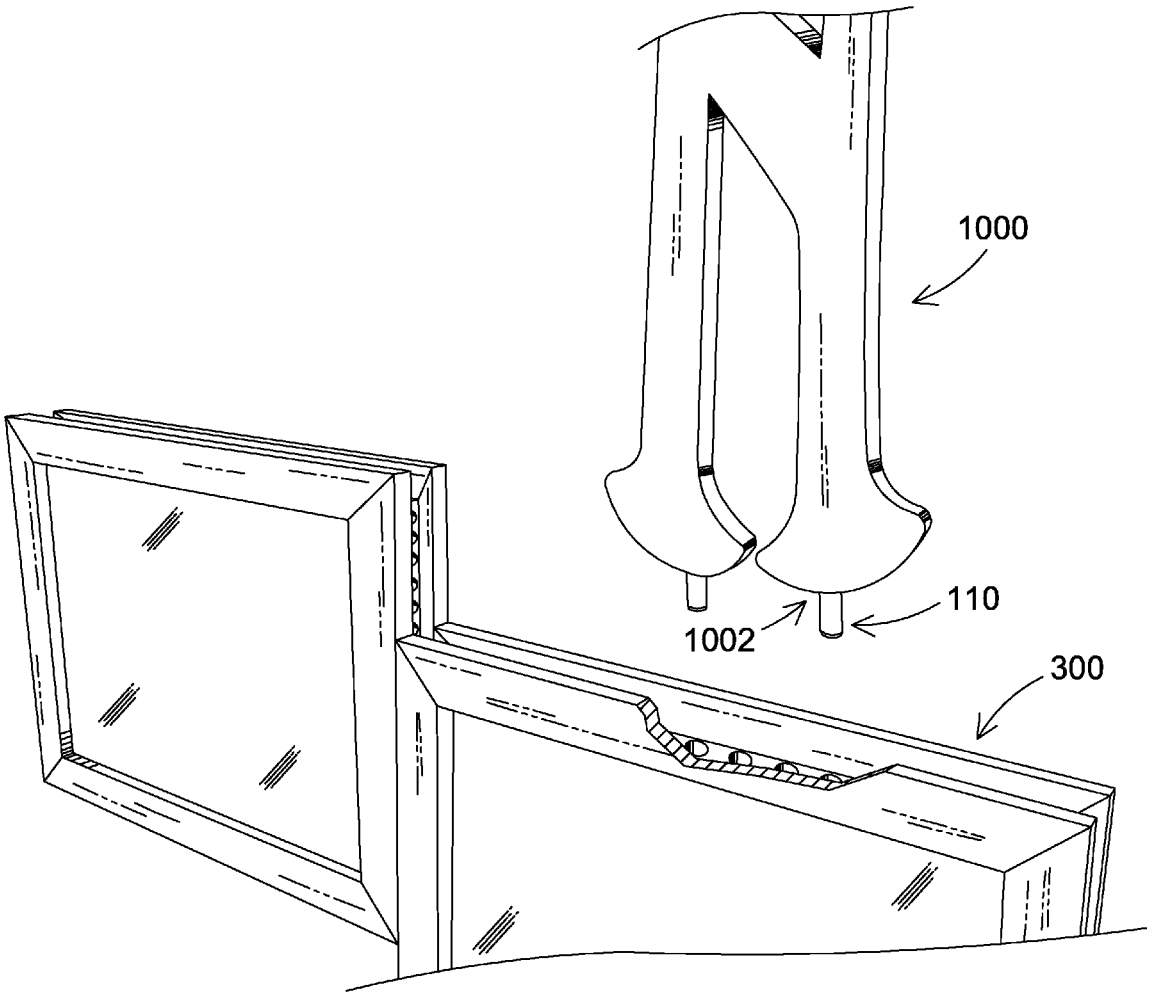
FIG. 11 is a perspective view of the decorative feature of FIG. 10 being coupled to the picture frame of FIG. 3, in accordance with the present invention.
Figure 12:
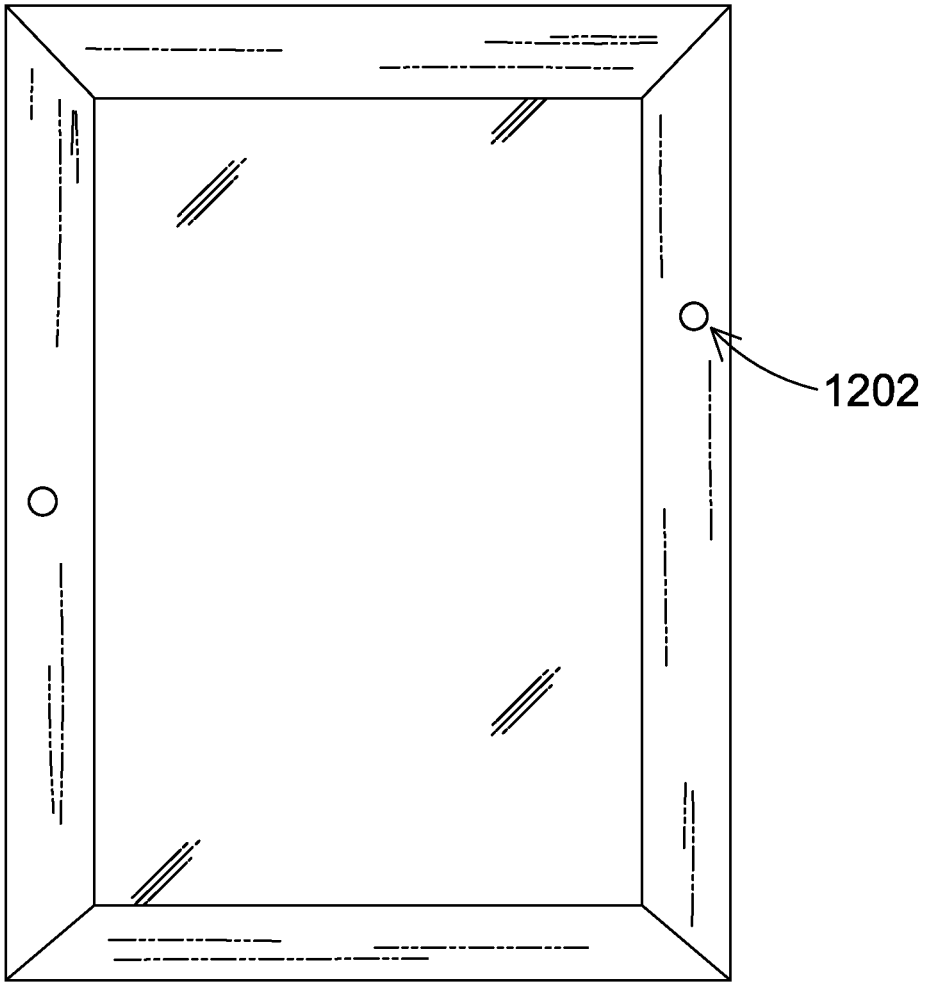
FIG. 12 is yet another exemplary picture frame, in accordance with an embodiment of the present invention.
Figure 13:
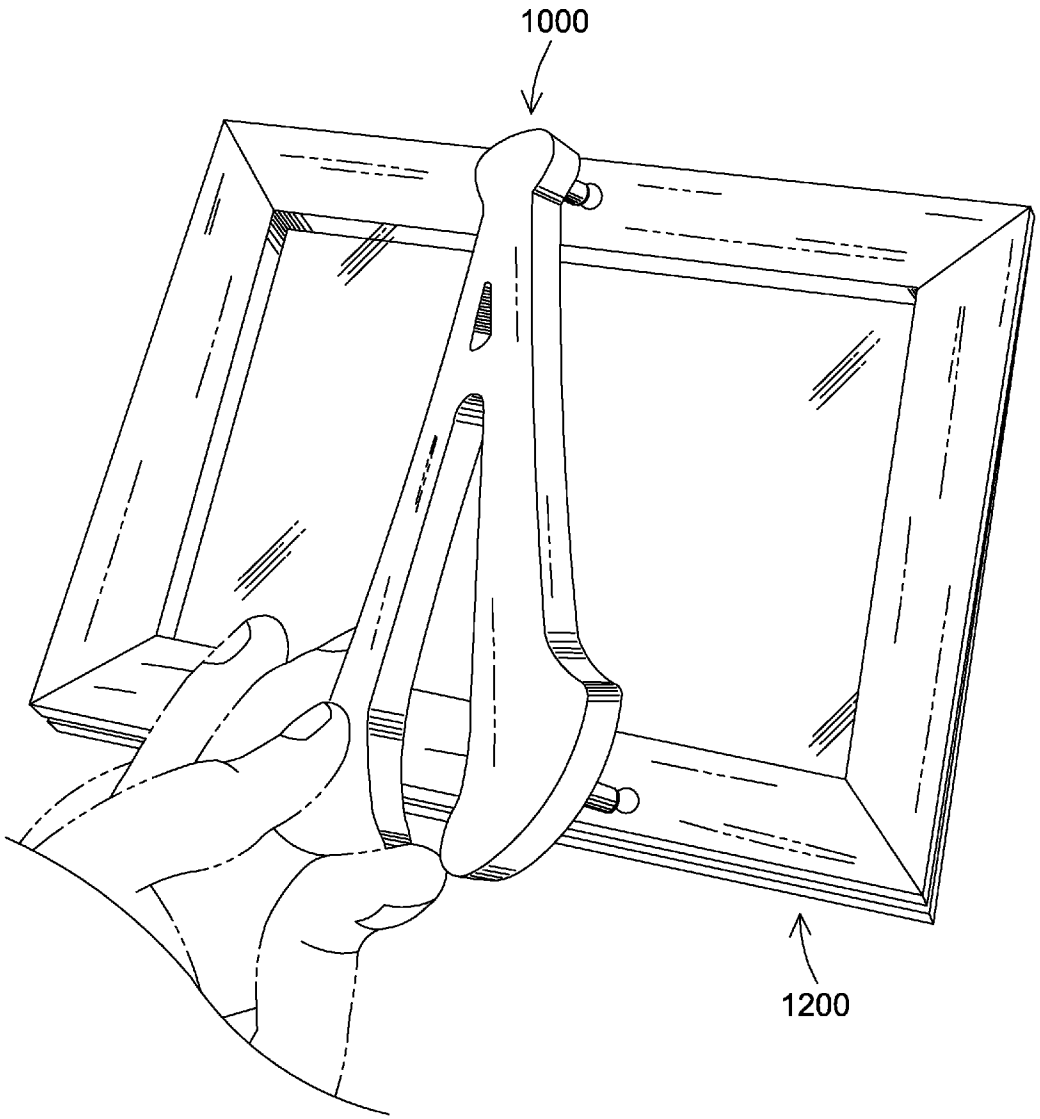
FIG. 13 is a front perspective view of the decorative feature of FIG. 10 being coupled to the picture frame of FIG. 12, in accordance with the present invention.

FIG. 11 illustrates use of a pair of coupling members 110 slideably inserted within the apertures 1002 defined by the decorative feature 1000 in order to couple the decorative feature 1000 to the picture frame 300. FIGS. 12 through 13 illustrate yet another exemplary method for selectively coupling decorative features 1000 to one or more picture frames 1200 to further personalize the picture frame collages. In the exemplary embodiment in FIGS. 12 and 13, the picture frame 1200 defines a plurality of apertures 1202 on a front portion of the picture frame 1200, as opposed to the side/lateral portions, as with the exemplary embodiments depicted in FIG. 1 and FIG. 3.

Advantageously, this allows consumers to further personalize and individualize the picture frame collages by also adding to the collages ornamental decorative features. In one embodiment, letters can be coupled to a collage of picture frames so as to, for example, spell out the name of a child or a person's initials. In another embodiment, a musician may couple one or more musical note shaped decorative features to a personalized picture frame collage.

Advantageously, the assembly, kit, and method of the present invention provides an easy to use, low cost, and efficient way for users to create unique, personalized picture frame collages.

What is claimed is:

1. A display system comprising:
a picture frame including:
a front face with an inner perimeter edge sized and shaped to frame a display item therein so as to be viewable from a front side of the picture frame by a viewer; and
a sidewall:
together with the front face, at least partially forming a hidden recessed channel disposed behind the front face of the picture frame so as to be concealed behind the front face when viewed by the viewer from the front side of the picture frame and simultaneously unconcealed from a lateral side of the picture frame when viewed by the viewer from the lateral side of the picture frame in a wall-mounted configuration; and
defining a plurality of bore-holes sized to receive a partial length of a coupling member therein and oriented to receive the partial length of the coupling member therein from the lateral side of the picture frame.

2. The display system in accordance with claim 1, wherein:
the coupling member is formed as a dowel fastener and each of the plurality of bore-holes is sized to receive the partial length of the dowel fastener therein.

3. The display system in accordance with claim 2, wherein:
the inner perimeter edge and an outer perimeter edge of the picture frame are both rectangle-shaped.

4. The display system in accordance with claim 3, wherein:
the picture frame further comprises a rear face, the front face and the rear face disposed on opposing sides of the hidden recessed channel.

5. The display system in accordance with claim 4, wherein:
the hidden recessed channel extends continuously about the inner perimeter edge.

6. The display system in accordance with claim 5, wherein:
the picture frame is formed from an injection-mold.

7. The display item in accordance with claim 5, wherein:
the picture frame is of a wood material.

8. The display system in accordance with claim 5, wherein:

at least one of the plurality of bore-holes is disposed on each face of the sidewall.

9. The display system in accordance with claim 8, wherein:

the plurality of bore-holes are equally spaced apart from one another.

10. The display system in accordance with claim 8, wherein:

each of the plurality of bore-holes defines a central axis extending in a direction parallel to a plane defined by the front face of the picture frame.

11. The display system in accordance with claim 1, further comprising:

a second picture frame including:

a front face with an inner perimeter edge sized and shaped to frame a display item therein so as to be viewable from a front side of the second picture frame by the viewer; and a sidewall:

together with the front face, at least partially forming a hidden recessed channel disposed behind the front face of the second picture frame so as to be concealed behind the front face of the second picture frame when viewed by the viewer from the front side of the second picture frame and simultaneously unconcealed from a lateral side of the second picture frame when viewed by the viewer from the lateral side of the second picture frame in the wall-mounted configuration; and defining a plurality of bore-holes sized to receive a partial length of a coupling member therein and oriented to receive the partial length of the coupling member therein from the lateral side of the picture frame; and at least one coupling member having a body sized and shaped for a partial insertion within one of the plurality of bore-holes of the picture frame and a simultaneous partial insertion within one of the plurality of bore-holes of the second picture frame for coupling the picture frame to the second picture frame.

12. A display kit comprising:

at least one picture frame including:

a front face with an inner perimeter edge sized and shaped to frame a display item therein so as to be viewable from a front side of the at least one picture frame by a viewer; and a sidewall:

together with the front face, at least partially forming a hidden recessed channel disposed behind the front face of the at least one picture frame so as to be concealed behind the front face when viewed by the viewer from the front side of the at least one picture frame and simultaneously unconcealed from a lateral side of the at least one picture frame when viewed by the viewer from the lateral side of the at least one picture frame in a wall-mounted configuration; and defining a plurality of bore-holes sized to receive a partial length of a coupling member therein and oriented to receive the partial length of the coupling member therein from the lateral side of the at least one picture frame; and a plurality of coupling members shaped for insertion within the plurality of bore-holes for the at least one picture frame.

13. The display kit in accordance with claim 12, wherein:

the coupling member is formed as a dowel fastener and each of the plurality of bore-holes is sized to receive the partial length of the dowel fastener therein.

14. The display kit in accordance with claim 13, wherein:

the inner perimeter edge and an outer perimeter edge of the picture frame are both rectangle-shaped.

15. The display kit in accordance with claim 14, wherein:

the picture frame further comprises a rear face, the front face and the rear face disposed on opposing sides of the hidden recessed channel.

16. The display kit in accordance with claim 15, wherein:

the hidden recessed channel extends continuously about the inner perimeter edge.

17. The display kit in accordance with claim 16, wherein:

the picture frame is formed as an injection-molded member.

18. The display kit in accordance with claim 16, wherein:

the picture frame is of a wood material.

19. The display kit in accordance with claim 15, wherein:

at least one of the plurality of bore-holes is disposed on each face of the sidewall.

20. A method of creating a collage of picture frames, the method comprising:

providing a first picture frame having:

a front face with an inner perimeter edge sized and shaped to frame a display item therein so as to be viewable from a front side of the first picture frame by a viewer; and a sidewall:

together with the front face, at least partially forming a hidden recessed channel disposed behind the front face of the first picture frame so as to be concealed behind the front face when viewed by the viewer from the front side of the first picture frame and simultaneously unconcealed from a lateral side of the first picture frame when viewed by the viewer from the lateral side of the first picture frame in a wall-mounted configuration; and defining a plurality of bore-holes sized to receive a partial length of a coupling member therein and oriented to receive the partial length of the coupling member therein from the lateral side of the first picture frame;

providing a second picture frame having at least one sidewall defining a plurality of bore-holes;

inserting a first end of the coupling member through a first one of the plurality of bore-holes defined by the first picture frame;

co-axially aligning the first one of the plurality of bore-holes defined by the first picture frame with a second one of the plurality of bore-holes defined by the second picture frame; and selectively coupling the first and second picture frame together by inserting a second end of the coupling member through the second one of the plurality of bore-holes, the second end opposite the first end.

* * * * *